US005421469A

United States Patent [19]

Lee

[11] Patent Number: 5,421,469

[45] Date of Patent: Jun. 6, 1995

[54] SYNTHETIC RESIN SEALING CAP FOR A FLUID BOTTLE

[75] Inventor: Yong-Hak Lee, 377-48, Shindang-2-dong, Chung-Ku, Seoul, Rep. of Korea

[73] Assignees: Morihiro Sudo, Tokyo, Japan; Yong-Hak Lee, Seoul, Rep. of Korea

[21] Appl. No.: 199,694

[22] Filed: Feb. 22, 1994

[30] Foreign Application Priority Data

Mar. 2, 1993 [KR] Rep. of Korea ..... 93-2915

[51] Int. Cl.[6] ..... B65D 45/30

[52] U.S. Cl. ..... 215/274; 215/247; 215/280

[58] Field of Search ..... 215/274, 247, 249, 280, 215/DIG. 3

[56] References Cited

U.S. PATENT DOCUMENTS

| | | | |
|---|---|---|---|
| 3,893,582 | 7/1975 | Kowalik | 215/274 |
| 3,904,059 | 9/1975 | Bellamy, Jr. et al. | 215/247 |
| 4,187,149 | 2/1980 | Tolbert et al. | 215/247 X |
| 4,211,333 | 7/1980 | Villarejos | 215/249 |
| 4,635,807 | 1/1987 | Knapp . | |
| 4,664,279 | 5/1987 | Obrist et al. . | |
| 4,668,458 | 5/1987 | Whitney . | |
| 4,754,889 | 7/1988 | Debetencourt . | |
| 4,760,935 | 8/1988 | van den Beld et al. . | |
| 4,770,309 | 9/1988 | Thompson . | |
| 4,801,033 | 1/1989 | Kanner . | |
| 4,801,040 | 1/1989 | Kraus . | |
| 4,811,855 | 3/1989 | Bergström et al. . | |
| 4,815,783 | 3/1989 | Montreuil et al. . | |
| 4,863,030 | 9/1989 | Bayer et al. . | |
| 5,080,245 | 1/1992 | Conard | 215/249 |
| 5,085,332 | 2/1992 | Gettig et al. | 215/249 |
| 5,125,921 | 6/1992 | Duschek | 215/247 X |
| 5,269,429 | 12/1993 | Schumacher | 215/249 |
| 5,303,835 | 4/1994 | Haber et al. | 215/247 |
| 5,314,084 | 5/1994 | Folta et al. | 215/249 |
| 5,316,163 | 5/1994 | von Schuckmann | 215/249 |

*Primary Examiner*—Gary E. Elkins
*Assistant Examiner*—Vanessa Caretto
*Attorney, Agent, or Firm*—Nixon & Vanderhye

[57] ABSTRACT

The present invention relates to a synthetic resin sealing cap for a fluid bottle, comprising an annular cover, a ring-like clamping member, a synthetic resin cap, and a sealing member. In the present invention, just pulling the cover up makes a separation of the cover and the sealing member fixed each other from the synthetic resin sealing cap, thereby conveniently injecting a syringe's needle into the exposed rubber stopper for use of the fluid inside the bottle. And also, the upper surface of the rubber stopper is not contaminated by fragments of aluminium and a surface coating agent since an aluminium cap is not used.

3 Claims, 4 Drawing Sheets

SYNTHETIC RESIN SEALING CAP FOR A FLUID BOTTLE

BACKGROUND OF THE INVENTION

1. Field of the Invention

The present invention relates to a sealing cap, more particularly to a synthetic resin sealing cap for a fluid bottle.

2. Description of the Prior Art

Conventional sealing cap for a fluid bottle seals the bottle with a synthetic resin cap covering an aluminium cap enclosing the rubber stoppered neck of a bottle. In this sealing structure, accordingly, there exist disadvantages in that the upper surface of the rubber stopper is apt to be contaminated by fragments of aluminium and a surface coating agent resulting from the manufacturing processes of the aluminium cap and a finished product, contaminants are easily infiltrated into the inside of a fluid bottle on injecting a syringe's needle into the rubber stopper following having removed a synthetic resin cap, and difficulties are raised when removing the synthetic resin cap and sealing the bottle.

SUMMARY OF THE INVENTION

It is an object of the present invention to provide a synthetic resin sealing cap for a fluid bottle.

A synthetic resin sealing cap for a fluid bottle according to the present invention comprises an annular cover having an upper flat base in which center an annular opening is formed, a projection inwardly and radially extended in the opening and a skirt forming a peripheral wall which downwardly extends from the upper flat base; a ring-like clamping member having an insertion groove formed along the inside wall thereof and a slanted portion formed along the inner periphery under the insertion groove; a synthetic resin cap constructed with a cap portion and a fastening portion integrally formed thereunder, wherein the cap portion has an upper flat base in which center an annular opening is formed and on the underside of which an annular wedge-like projection is formed, and the fastening portion is constituted with a plurality of fastening sections split from each other and respectively having an elastic portion with an arc-shaped projection along the end thereof and an arc-shaped fastening flange inwardly extended therefrom; and a sealing member having an upper projection and a lower projection which are outwardly and radially extended and integrally formed at the ends of a cylindrical portion, wherein the lower projection has a downwardly tapered wedge integrally formed thereunder.

The sealing member is inserted into and fitted with the annular cover, the ring-like clamping member is mounted around the outer peripheral wall of the cap portion of the synthetic resin cap through insertion thereof for inwardly and radially clamping the peripheral wall, and then the cover firmly covers the top of the synthetic resin cap. The synthetic resin sealing cap constructed as above goes through a process of sterilization.

The sterilized synthetic resin sealing cap is put to enclose the stoppered neck of a bottle. In this state, the ring-like clamping member is downwardly pushed in order for the inwardly extended arc-shaped flange to be firmly contacted with the neck.

Therefore, a complete sealing of the bottle can be simply accomplished.

Just pulling the cover up makes a separation of the cover and the sealing member fitted to each other from the synthetic resin sealing cap, thereby conveniently injecting a syringe's needle into the exposed rubber stopper for use of the fluid in the bottle. And also, the upper surface of the rubber stopper is not contaminated by fragments of aluminium and a surface coating agent since an aluminium cap is not used.

DESCRIPTION OF THE PREFERRED EMBODIMENT

Figure 1:
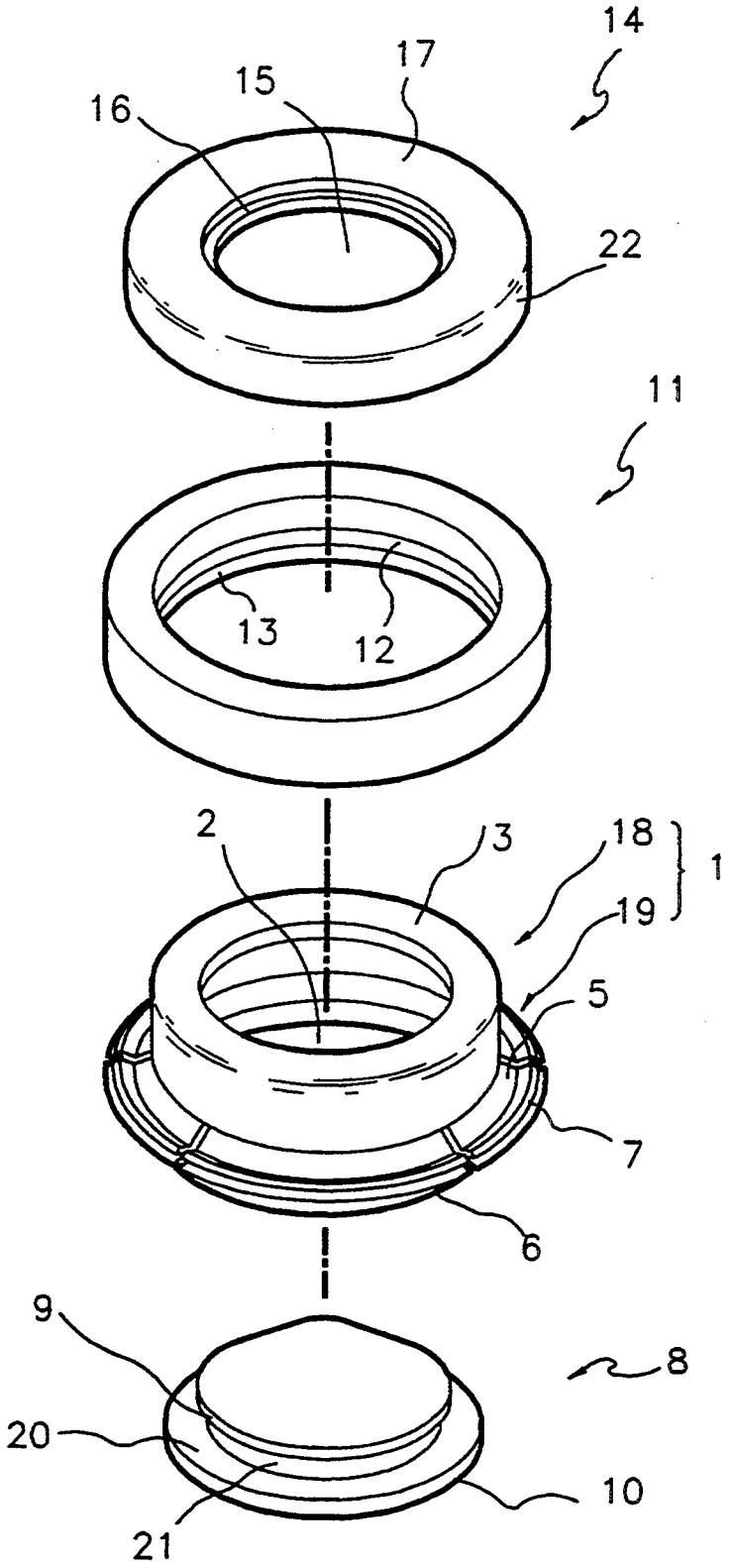
FIG. 1 is an exploded perspective view of a synthetic resin sealing cap according to the present invention.

FIG. 1 is an exploded perspective view of a synthetic resin sealing cap according to the present invention. As shown in FIG. 1, a synthetic resin sealing cap for a fluid bottle according to the present invention comprises an annular cover 14 having an upper flat base 17 in which center an annular opening 15 is formed, a projection 16 inwardly and radially extended in the opening 15 and a skirt 22 forming a peripheral wall which downwardly extends from the upper fiat base 17; a ring-like clamping member 11 having an insertion groove 12 formed along the inside wall thereof and a slanted portion 13 formed along the inner periphery under the insertion groove 12; a synthetic resin cap 1 constructed with a cap portion 18 and a fastening portion 19 integrally formed thereunder, wherein the cap portion 18 has an upper flat base 3 in which center an annular opening 2 is formed and on the underside of which an annular wedge-like projection is formed, and the fastening portion 19 is constituted with a plurality of fastening sections split from each other and each respectively having an elastic portion 5 with an arc-shaped projection 7 along the end thereof and an arc-shaped fastening flange 6 inwardly extended therefrom; and a sealing member 8 having an upper projection 9 and a lower projection 20 which are outwardly and radially extended and integrally formed at the ends of a cylindrical portion 21, wherein the lower projection 20 has a downwardly tapered wedge 10 integrally formed thereunder.

The sealing member 8 is inserted into the opening 15 of the cover 14 so as to be fitted with the cover 14. The ring-like clamping member 11 is mounted around the outer peripheral wall of the cap portion 18 of the synthetic resin cap I through insertion thereof. And then the cover 14 fitted with the sealing member 8 firmly covers the top of the synthetic resin cap 1.

The synthetic resin sealing cap constructed as in the above goes through a process of sterilization.

Figure 2A:
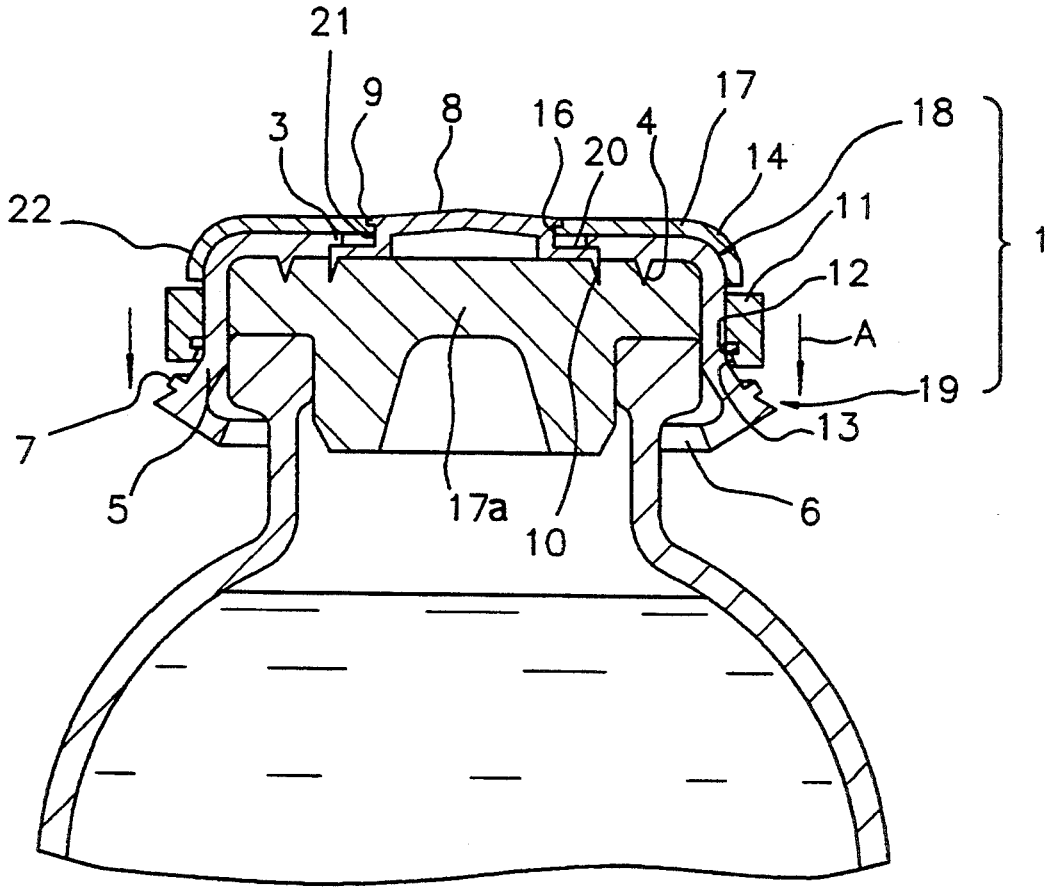
FIG. 2A is a cross-sectional view of a synthetic resin sealing cap according to the present invention before pushing a clamping member down.
Figure 2B:
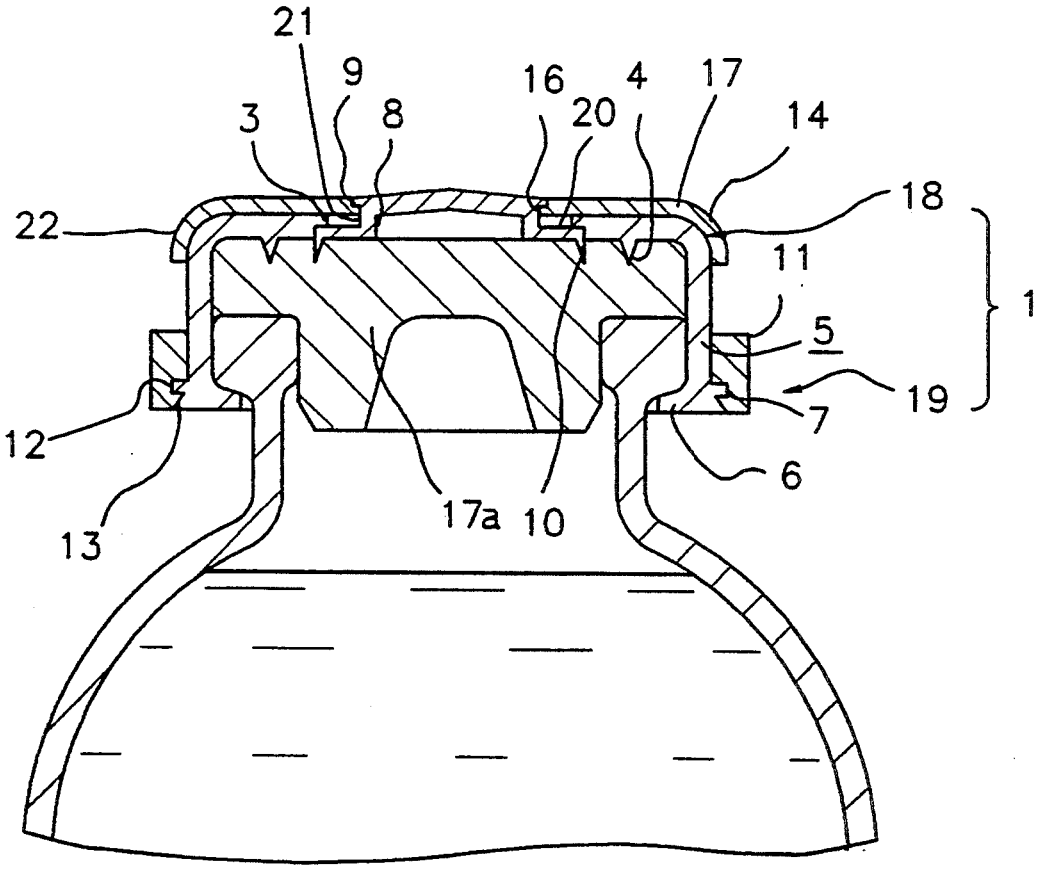
FIG. 2B is a cross-sectional view of a synthetic resin sealing cap according to the present invention after pushing a clamping member down.

FIG. 2A and FIG. 2B show the operations of the clamping member 11 and the fastening portion 19 of the synthetic resin cap 1. After the synthetic resin sealing cap has been put to enclose the stoppered neck of a fluid bottle, as shown in FIG. 2A, the clamping member 11 is forced down (arrow A direction in FIG. 2A) by an assembling machine so that the fastening portion 19 of the synthetic resin cap 1 is inwardly and radially clamped. The pushing-down operation by the assembling machine continues until the arc-shaped projection 7 of the fastening portion 19 is inserted into the insertion groove 12 of the clamping member 11. When the arc-shaped projection 7 is inserted in the insertion groove 12, as shown in FIG. 2B, the arc-shaped fastening flange 6 of the fastening portion 19 firmly clamps the outer periphery of the neck of a fluid bottle, thereby accomplishing complete sealing for the fluid bottle.

And also, the wedge-like projection 4 of the synthetic resin cap 1 and a tapered wedge 10 are pressed into the rubber stopper 17*a* so as to prevent a foreign substance from being infiltrated into the bottle from the outside.

Figure 3:
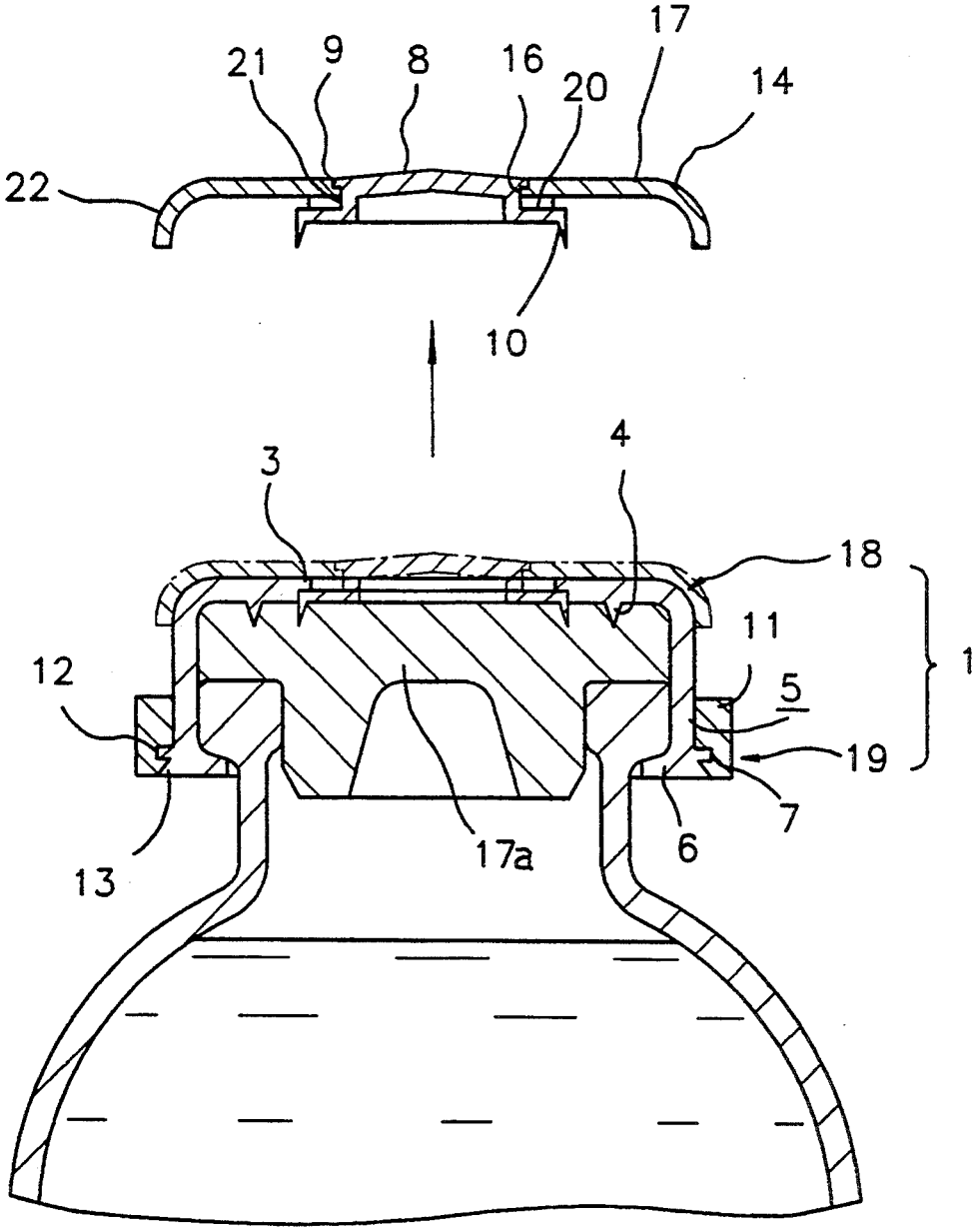
FIG. 3 is a view showing a cover separated from the synthetic resin sealing cap according to the present invention.

The cover 14 can be detached from the synthetic resin cap 1 just by pushing it up, as shown in FIG. 3, and at the same time, the sealing member 8 is also separated together with the cover 14 from the synthetic resin cap 1 since the sealing member 8 is fitted with the cover 14 by the projections 9 and 16.

The tapered wedge 10 is so thin in its thickness that it can be easily bent by the upper flat base 3 when being lifted.

Since the synthetic resin sealing cap according to the present invention does not employ an aluminium cap, its production cost is low and the upper surface of the rubber stopper is not stained by contaminants such as fragments of aluminium and a surface coating agent during the producing the synthetic resin sealing cap or after the finishing of its production.

What is claimed is:

1. A synthetic resin sealing cap for a fluid bottle comprising:

an annular cover having an upper flat base and a center within which an annular opening is formed, a projection inwardly and radially extended in the opening and a skirt forming a peripheral wall which downwardly extends from the upper flat base;

a ring-like clamping member having an insertion groove formed along an inside wall thereof and a slanted portion formed along art inner periphery under the insertion groove;

a synthetic resin cap constructed with a cap portion and a fastening portion integrally formed thereunder, wherein the cap portion has an upper flat base in the center of which an annular opening is formed and on an underside of which an annular wedge-like projection is formed and the fastening portion comprises a plurality of fastening sections split from each other and respectively having an elastic portion with an arc-shaped projection extending outwardly along an end thereof and an arc-shaped fastening flange inwardly extended therefrom; and a sealing member having a cylindrical portion and having an upper projection and a lower projection which are both outwardly and radially extended and integrally formed at the ends of said cylindrical portion, wherein the lower projection has a downwardly tapered wedge integrally formed thereunder.

2. A synthetic resin sealing cap according to claim 1, wherein the upper projection of said sealing member is engaged with the inwardly and radially extended projection of said annular cover and said ring-like clamping member requires force to be pushed down thereby engaging the insertion groove with the external outwardly projecting arc-shaped projection.

3. A synthetic resin sealing cap for a fluid bottle comprising:

an annular cover having a center within which an annular opening is formed, said annular cover including a projection inwardly and radially extended in said annular opening;

a ring-like clamping member having an insertion groove formed along an inside wall thereof;

a synthetic resin cap having an integrally/brined cap portion and fastening portion, said fastening portion comprises a plurality of fastening sections split from each other and respectively having an elastic portion with an arc-shaped projection extending outwardly along an end thereof; and a sealing member having a lower projection which is outwardly and radially extended, wherein said lower projection has a downwardly tapered annular wedge integrally formed thereunder.

* * * * *